US008469410B2

(12) United States Patent
Wood

(10) Patent No.: US 8,469,410 B2
(45) Date of Patent: Jun. 25, 2013

(54) DOOR SAFETY SYSTEM

(76) Inventor: Timothy Wood, Hilliard, OH (US)

( * ) Notice: Subject to any disclaimer, the term of this patent is extended or adjusted under 35 U.S.C. 154(b) by 645 days.

(21) Appl. No.: 12/487,302

(22) Filed: Jun. 18, 2009

(65) Prior Publication Data

US 2009/0322106 A1 Dec. 31, 2009

Related U.S. Application Data

(60) Provisional application No. 61/073,588, filed on Jun. 18, 2008.

(51) Int. Cl.
*E05C 19/18* (2006.01)

(52) U.S. Cl.
USPC ..... 292/288

(58) Field of Classification Search
USPC ..... 292/288
See application file for complete search history.

(56) References Cited

U.S. PATENT DOCUMENTS 4,386,797 A * 6/1983 Duran, Sr. ..... 292/292
4,575,140 A * 3/1986 Dargis ..... 292/288
4,955,648 A * 9/1990 Miller ..... 292/258
5,507,539 A * 4/1996 Basinski ..... 292/92
6,416,089 B1 * 7/2002 Williams, Jr. ..... 292/288
6,487,751 B2 * 12/2002 Renaud ..... 16/83
6,658,906 B1 * 12/2003 Wright ..... 70/455
7,637,130 B2 * 12/2009 Carr ..... 70/14
2002/0067046 A1 * 6/2002 Cox, Sr. ..... 292/289
2008/0148791 A1 6/2008 Morrison
2010/0122559 A1 * 5/2010 Chudzicki ..... 70/56

* cited by examiner

*Primary Examiner* — Carlos Lugo
*Assistant Examiner* — Mark Williams
(74) *Attorney, Agent, or Firm* — Standley Law Group LLP

(57) ABSTRACT

A door safety system that includes a body having a first portion with an aperture for accepting a door handle and a second portion for engaging a door frame so that the second portion prevents the door from opening. The door safety system may further include a securing member having a first portion that is adapted to secure to a door and a second portion for engaging the body so that the securing member prevents movement of the body in at least one plane. Exemplary embodiments of the door safety system may further include a housing that comprises: a fastening mechanism; an alarm system; a means for mounting the housing to a wall; a front body; and a mounting body.

17 Claims, 9 Drawing Sheets

DOOR SAFETY SYSTEM

CROSS-REFERENCE TO RELATED APPLICATIONS

This application is a non-provisional patent application and claims priority to U.S. Provisional Application No. 61/073,588 filed Jun. 18, 2008, which is hereby incorporated by reference as if fully rewritten herein.

TECHNICAL FIELD

Exemplary embodiments relate to a door safety system and, more particularly, to a door safety system that secures a door or doors without requiring the use of a key or combination device and may provide a means to alert individuals of a possible attack.

BACKGROUND OF THE ART

Many different types of doors have the capability to lock and secure. Typically, a door locks and secures from using a combination of a locking mechanism and either a key or combination device. If the door is locked, each user must either have the key with them or must know the combination of the lock to unlock the door. This may be burdensome in some situations, especially where certain attire may not allow an individual to have the key on their person at all times. An example may be when a female teacher is wearing a dress during her lecturing.

One example is in the classroom setting, more specifically, when a substitute teacher is substituting in a school classroom. Generally, the school does not wish to give each substitute teacher a key or the combination for their building or individual classroom. The school may desire to keep the amount of keys and combinations to buildings and individual classrooms to a minimum. Schools may wish that their buildings and individual classrooms are securely locked on a nightly basis to ensure classroom supplies are not vandalized or stolen. By limiting access to keys or combinations to buildings or individual classrooms, in theory, the school reduces the chance that a building and individual classrooms may be vandalized.

Furthermore, in many situations, particularly within school buildings, federal law (OSHA) states that doors must be free of any device or alarm that could resist emergency use of the exit route if the device or alarm fails. Additionally, federal law requires that exit doors, doors into and out of classrooms and school buildings, must be egress doors to facilitate evacuation in emergency situations. For these reasons, all exit doors in school buildings and other public buildings must utilize egress doors.

However, in some situations, particularly in school buildings, there is a need for individuals to secure the doors of buildings and/or individual classrooms to prevent attackers from entering because of threats. These threats are increasing due in part to the growing number of school shootings that have occurred in the recent past and to the rise in the potential for terrorist attacks. The United States government is so disturbed about the increase in school shootings that it started the Safe School Initiative with the help of the U.S. Department of Education and the U.S. Secret Service to help thwart future school shootings.

In numerous situations, normally the threat or attack springs up unexpectedly with little to no time to react to the escalating situation. Additionally, in many situations, the attacks are stopped by means other than law enforcement intervention, despite oftentimes the prompt response of law enforcement. Moreover the Safe School Initiative found that many school shootings, in particular, occur during school hours where the attacker aims to injure or kill more than just one victim. Likewise, terrorist attacks frequently occur to injure or kill more than one victim.

What is needed is a door safety system that does not require a key or combination device to secure a door or doors. Also, a door safety system is desired which provides a warning mechanism to alert others, preferably including authorities, that an attack may be occurring. Further, it is desired that the system is an inexpensive means to reduce the likelihood of attack by individuals.

SUMMARY OF THE INVENTION

In contrast to known means of locking and securing a door or doors which, for example, may require a locking featuring that includes a lock mechanism and either a key or combination device, exemplary embodiments may permit an individual to secure a door or doors by situating a body around the handle of a door that secures the door or doors, while alerting other individuals that an attack may be occurring. With exemplary embodiments of the door safety system, there is no longer a need for individuals to maintain keys or the knowledge of a combination to quickly secure doors.

In addition, exemplary embodiments of the door safety system may improve safety and security of buildings by warning or alarming other individuals and/or proper authorities of an impending or proceeding threat. Exemplary embodiments of the system may improve safety and security because the frame may increase the door securement strength. Furthermore, exemplary embodiments may reduce the response time due to the relative ease it takes to situate the body around a door handle. Also, exemplary embodiments may reduce the response time of authorities and improve the response by authorities due to the light board indicating where point of disturbance initiated.

Another object of exemplary embodiments is to provide a cost-effective way to secure doors from unwanted entry while alerting individuals about a potential attack. Also, an additional embodiment of the door safety system may provide a warning mechanism to alert others, preferably including authorities, an attack may be occurring.

While certain embodiments are described in detail herein, the scope of the invention is not to be considered limited by such disclosure, and modifications are possible without departing from the spirit of the invention.

BRIEF DESCRIPTION OF THE DRAWINGS

Other aspects of exemplary embodiment of the door safety system will be readily apparent from the following descriptions of the drawings and exemplary embodiments, wherein identical reference numerals refer to identical parts, and wherein.

DETAILED DESCRIPTION OF THE EXEMPLARY EMBODIMENTS

Some sample embodiments will now be described in greater detail. Nevertheless, it should be recognized that exemplary embodiments can be practiced in a wide range of other embodiments besides those explicitly described, and the scope of the door safety system is expressly not limited except as specified in any accompanying claims.

Figure 1:
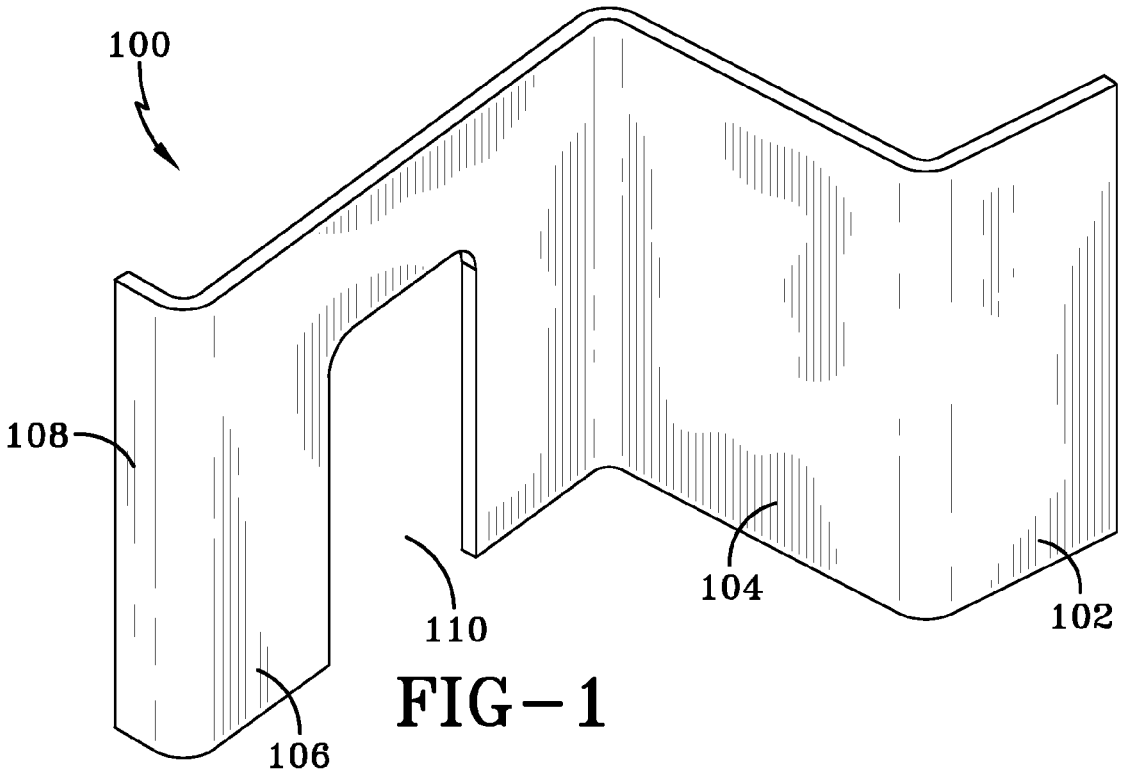
FIG. 1 is a perspective view of an exemplary embodiment of the body of the door safety system.
Figure 2:
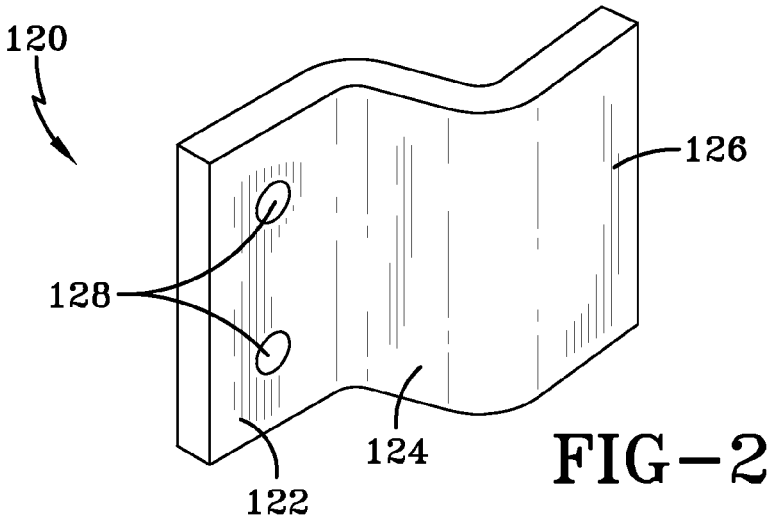
FIG. 2 is a perspective view of an exemplary embodiment of the securing member of the door safety system.

FIGS. 1 and 2 illustrate an exemplary embodiment of a door safety system 10 for use with egress doors. As seen, this particular embodiment of the door safety system includes a body 100 and a securing member 120. In this embodiment, the body 100 has a first, second, third and fourth member 102, 104, 106 and 108. Other embodiments may not include the fourth member 108. Additionally, in this particular embodiment, the first member 102 runs substantially parallel with the third member 106. Likewise, the second member 104 runs substantially parallel with the fourth member 108. Furthermore, the second member 102 is approximately perpendicular to the first and third members 102, 106. Similarly, the fourth member 108 is approximately perpendicular to the third member 106. In this embodiment, the third member 106 has an aperture 110 protruding inward from the bottom edge of the third member 106. Further, the top of the aperture 110 is substantially curved, while the sides of the aperture 110 run substantially parallel with the vertical sides of the third member 106. In other embodiments, the top of the aperture 110 may be any other number of geometries that allow the aperture 110 to at least partially surround the doorknob handle. Also, in this embodiment, the width of the aperture 110 must be at least slightly greater than the width of the doorknob handle so that an individual may situate the aperture 110 around the doorknob handle when securing a door. In other embodiments, depending upon the operational factors and materials used, the aperture 110 may have any number of shapes and sizes within the third member 106.

In this embodiment, each member of the body 100 is 3/16" thick steel. However, in other embodiments, depending upon the design and operational factors, one skilled in the art would understand that the members of the body 100 may be any variety of thicknesses and materials. In addition, in this embodiment, the body 100 is fabricated from one solid sheet wherein the members are integral with one another. By using stock sheet-metal, the fabrication cost may be reduced. In other embodiments, the members may be fabricated separately and attached to one another by any number of connecting means, such as, but not limited to: threaded fasteners, welding, clamping, nailing, pinning, riveting, screwing, latching, etc. In this embodiment, the height of the first, second, third and fourth members 102, 104, 106 and 108 are approximately the same. However, in other embodiments, the height of each member may vary. Additionally, all surfaces of the members may be rounded to prevent injuries.

In this particular example, the securing member 120, has a first, second and third member 122, 124, 126. Furthermore, the first member 122 runs substantially parallel with the third member 126. Also, the second member 124 is approximately perpendicular to the first and third members 122 and 126. Typically, the first member 122, has at least one hole 128 adapted to receive the head of a screw or nail on the side opposite the door. In this embodiment, the first member 122 has two holes 128, with one hole aligned substantially vertical above the second hole. Furthermore, both holes 128 are located towards the midpoint of the width and located substantially equidistant from the midpoint of the height of the first member 122. In other embodiments, the holes 128 may be located at different locations on the first 122, depending upon design factors and the materials used. Like the body 100, the securing member 120 is fabricated from one solid sheet wherein the members are integral with one another, with alternatives similar to the body 100. Also, the securing member 120 is fabricated from steel in this embodiment, but may be made of other materials similar to the body 100. In this embodiment, the height of the first, second and third members 122, 124 and 126 are approximately the same. However, in other embodiments, the height of each member may vary. Additionally, all surfaces of the members may be rounded to prevent injuries.

Figure 3:
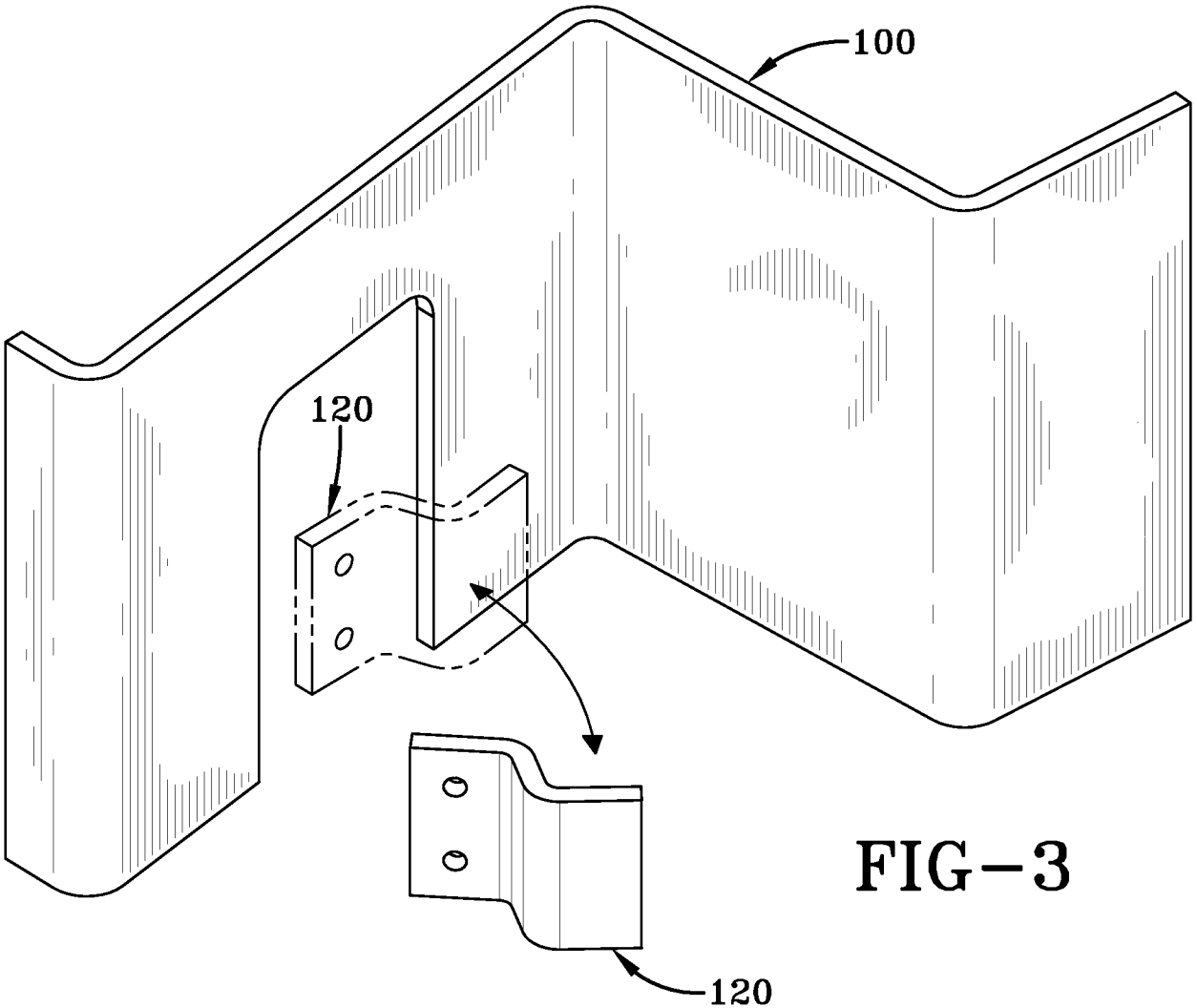
FIG. 3 is an enlarged perspective side view of an exemplary embodiment of the body of FIG. 1 placed in relation to the securing member of FIG. 2.
Figure 4:
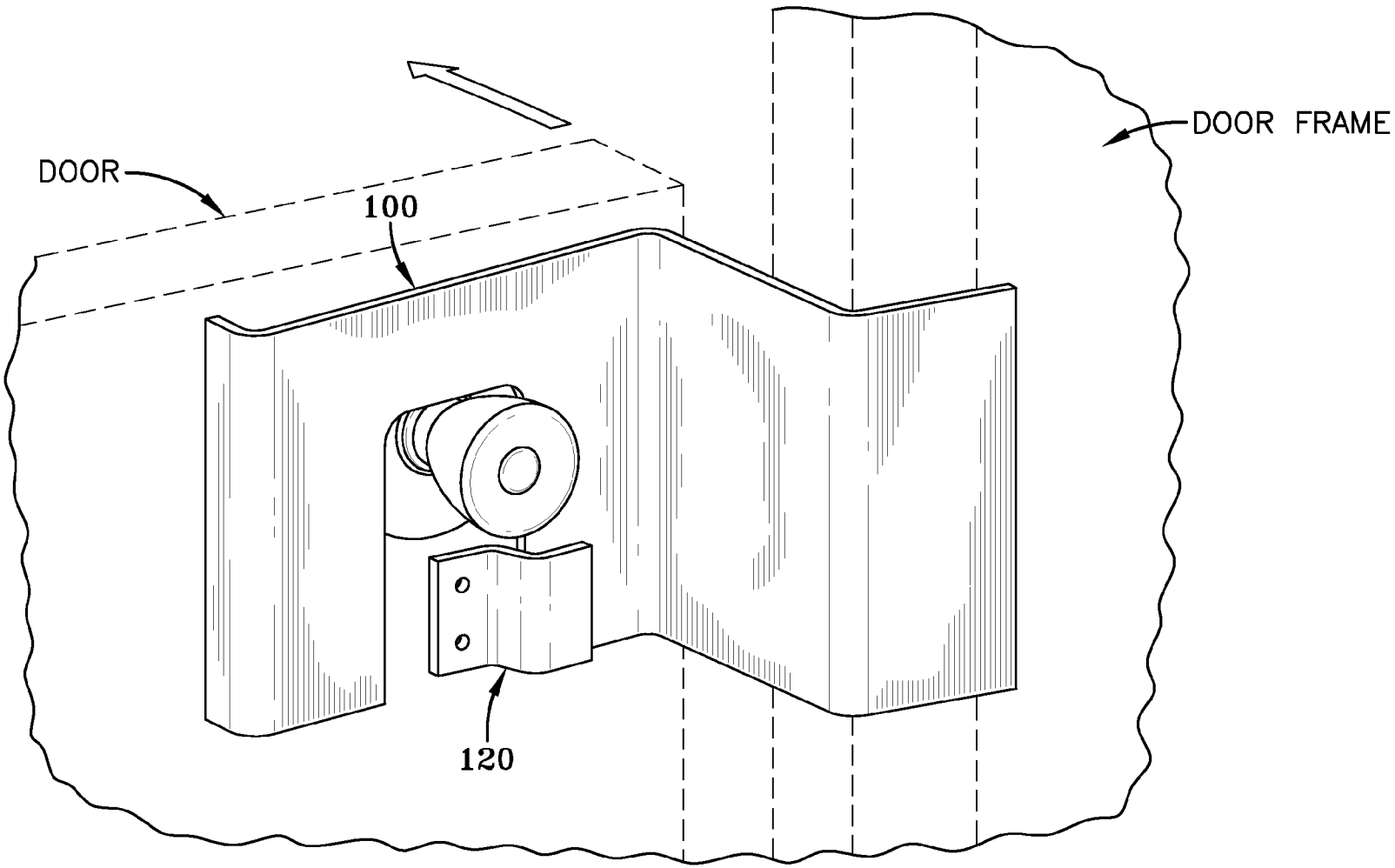
FIG. 4 is a perspective view of the FIG. 3 embodiment as seen secured to a door frame.

FIGS. 3 and 4 illustrate one exemplary embodiment of how the body 100 may be placed in relation to the securing member 120 when securing a door in the closed position. In this embodiment, the outer vertical edge of the fourth member 108 of the body 100 engages the front face of the door. Upon securing the body around the door handle, the width of the fourth member 108 is substantially perpendicular from the front face of the door. Additionally, the width of the third member 106 runs substantially parallel with the width of the door and is preferably, but not necessarily, a length less than the length of the door handle protruding from the front face of the door. The width of the third member 106 is a length that is at least a length from the unhinged edge of the door and will extend past the entire door-handle shaft protruding from the door, so as the aperture 110 discussed above is included in the body 100. In this particular embodiment, when the body 100 of the system 10 is secured, the right edge the third member 106 is located in close approximation to the unhinged edge of the door. Additionally, the top of the aperture 110 is in close approximation of the door-handle shaft.

In this embodiment, the width of the second member 104 runs substantially parallel to the inside wall of the unhinged side of the door frame. Preferably, but not necessarily, a portion of the second member 104 engages the inside wall of the unhinged side of the door frame. Moreover, the width of the second member 104 is typically a length longer than the approximate width of the inside wall of the unhinged side of the door frame that is visible when the door is closed. Also, the width of the first member 102 runs substantially parallel to the front wall of the unhinged side of the door frame. In this embodiment, the width of the first member 102 is approximately the width of the front wall of the unhinged side of the door frame. However, in other embodiments, depending on the design characteristics and materials used, one skilled in the art would understand that the width of the first member 102 may be longer or shorter than the width of the front wall of the unhinged side of the door frame. Preferably, but not necessarily, a portion of the first member 102 engages the front wall of the unhinged side of the door frame.

Preferably, but not necessarily, the securing member 120 used to restrict rotation of the body 100 is engaged with the door. In this embodiment, the securing member 120 engages the door by the use of two screws inserted through complimentary holes 128 located on the first member 122 of the securing member 120. However, in other embodiments, the securing member 120 may be engaged to the door using any number of fastening including, but not limited to: welding, clamping, nailing, pinning, riveting, latching, etc. Furthermore, in this embodiment, when the body 100 is located to secure the door, the securing member 120 is engaged with the door so that the second and third members 124 and 126 restrict the outward and lateral movement of the body 100 from the door. Typically, the securing member is situated towards the bottom of the aperture 110 of the body 100, wherein at least a portion of the second member 104 of the body 100 is positioned between the front face of the door and at least a portion of the third member 126 of the securing member 120. Additionally, a portion of the securing member 120 may engage the right edge of the aperture 110 and/or the front face of the second member 104 of the body 100.

In other embodiments, the securing member 120 may be situated to engage different areas of the body 100, depending upon design factors and other operational needs, as would be known by one in the art. Additionally, the system 10 may include more than one securing member 120 to engage the body during operation of the system 10. Furthermore, the securing member 120 may be any type of fastening means that would limit the vertical and lateral movement of the body 100 as would be understood by one in the art, such as, but not limited to: a sliding member situated across the aperture that may lock, a hook and clasp system, etc.

During operation of the system 10 with an egress door, in one embodiment, an individual may manually slide the body 100 substantially downward so that the aperture 110 surrounds at least a portion of the door handle and helps facilitate securing the door from opening outward. Typically, when a second individual tries to open the egress door by pulling on the door handle from the outside, at least a portion of the first member 102 engages the front face of the door frame at the same time that at least a portion of the third member 106 engages the door handle and at least a portion of the second member 104 may engage at portion of the inside face of the door frame. The combination of engaging members inhibits the second individual from outwardly opening the door. In some exemplary embodiments, a securing member 120 may be secured to the front face of the door to inhibit the lateral and/or rotational movement of the body 100 while the second individual is trying to forcibly outwardly open the door. In exemplary embodiments, at least a portion of the second and third members 122 and 124 of the securing body 120 may engage at least a portion of the first, second, third or fourth members 102, 104, 106 and/or 108 of the body 100, depending upon the arrangement of where the securing body 120 is secured to the door. The placement of one such embodiment including the body 100 and the securing body 120 of the system 10 is described above.

Figure 5:
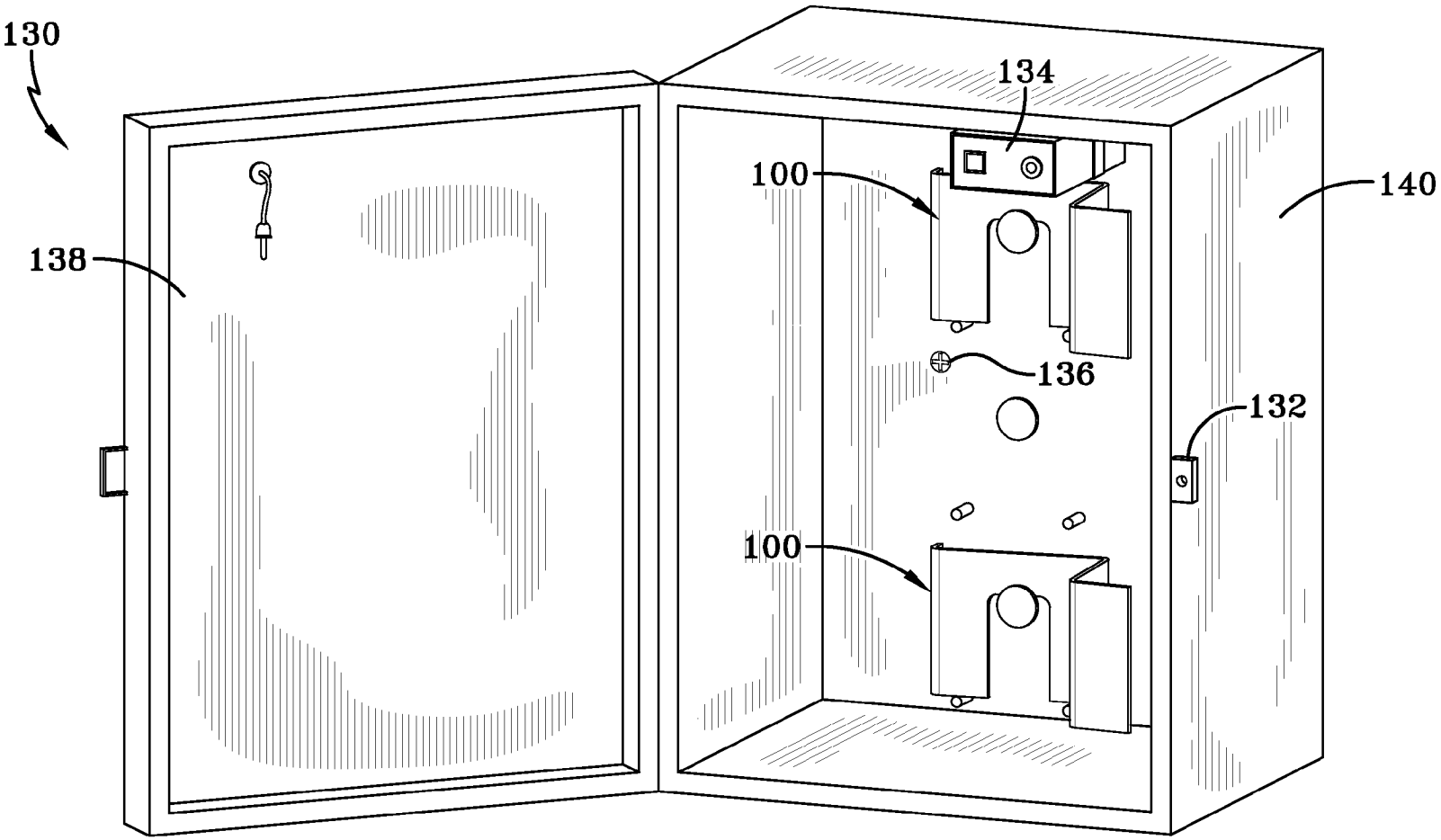
FIG. 5 is a perspective view of an exemplary embodiment of a door safety system.
Figure 8:
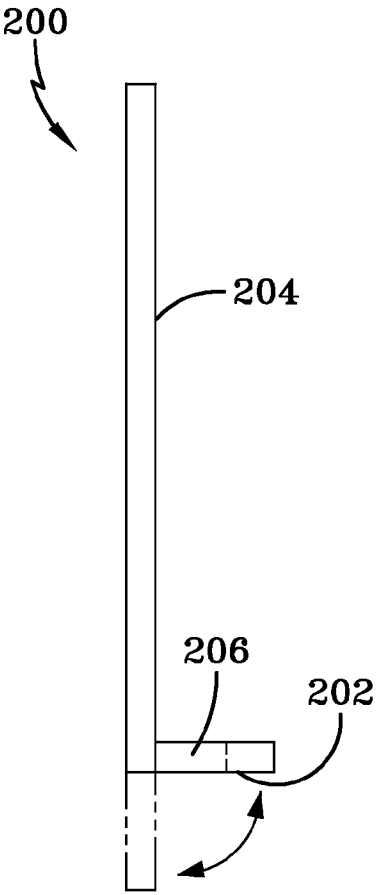
FIG. 8 is a right side view of the exemplary embodiment of FIG. 6.

Referring to FIG. 5, the rest of the major components of an exemplary embodiment of the system 10 are shown. In this particular embodiment, a housing 130 includes a fastening mechanism 132, an alarm system 134, and a means for mounting the housing to a wall 136. In this embodiment, the housing 130 is made of two different components, a front body 138 and a mounting body 140. In this particular embodiment, the mounting body 140 is substantially cuboid in shape, with the sixth side open. In this particular embodiment, the mounting body has a length and width of seven inches and a depth of three inches. However, depending upon the size of the design materials of the body 100 and other design and operational factors, the size and shape of the body may vary, as would be understood by one skilled in the art. The mounting body 140 must be of sufficient size to house all of the components of each particular embodiment of the system 10.

The mounting body 140 is made of steel in this embodiment. However, in other embodiments, the mounting body 140 may be made of any variety of materials, including, but not limited to: metals, plastics, fiberglass, etc. Further, in this embodiment the steel used to fabricate the body is made from one sheet, where four faces of the sheet are bent up and preferably, secured together. The faces are secured together using rivets in this embodiment, but may be secured together by welding, nails, screws, etc. In other embodiments, all the faces of the mounting body 140 may be integral with one another and produced by a casting or molding method. Further, each face of the mounting body 140 may be fabricated separately and secured by any of the aforementioned fastening means.

Situated on the back face of the mounting body 140 is a means for attaching the housing to a wall 136. In this particular embodiment, the means for mounting the housing to a wall 136 is a set of two holes wherethrough screws or nails may pass to secure the housing to a wall. In other embodiments, the means for mounting the housing to a wall 136 may be any variety of mounting means that would be understood by one skilled in the art, including, but not limited to: bolting, cabling, clamping, docking, hooking, welding, etc.

In this embodiment, like the mounting body 140, the front body 138 is substantially cuboid in shape with dimensions that compliment the mounting body 140. In this particular embodiment, the front body 138 is approximately seven inches in width and height and ¾ of an inch in depth. However, the geometry and size of the front body may vary depending upon the geometry and size of the mounting body 140. Typically, when the front body 138 is closed and locked, it is preferred, but not necessary that at least a portion of the lip produced by the depth of the front body 138 at least partially surrounds a complimentary portion of the mounting body 140. Additionally, in this embodiment, the front body 138 is attached to the mounting body 140 by a hinge. Although the hinge may be located on any face of the mounting body 140, in this embodiment the hinge is located on the left face of the mounting body 140 and front body 138. In other embodiments, the front body 138 may be attached to the mounting body 140 by a slidable engagement that may be secured by any fastening means, including, but not limited to: a press fit, a snap-lock feature, a hook and clasp, material such as the type marketed under the trademark Velcro, etc.

Inside the housing 130, this particular embodiment contains an alarm system 134. The alarm system 134 is engaged with the top face of the mounting body 140 and the inside face of the front body 138. The alarm system 134 emits noise and/or light whenever the component of the alarm 134 secured on the inside face of the front body 138 is not in close approximation with the component of the alarm system 134 engaged with the top face of the mounting body 140. Preferably, not necessarily, the component of the alarm system 134 may be removably affixed to the top face of the mounting body 140 by a material such as the type marketed under the trademark Velcro, wherein an individual may remove this component and place it, for example, in a school building hallway to warn others of an emergency situation by emitting noise and/or light. Additionally, the mounting body 140 may include a hook or other fastening means to releasably retain a container of pepper spray or other substance or items to aid in stopping potential attackers. In this embodiment, a fastening mechanism 132 engages the unhinged end of the front body 138 to the mounting body 140. In this embodiment, the fastening mechanism 132 is a hook and clasp mechanism with the clasp located on the front body and the complimentary hook located on the mounting body. However, in other embodiments, any number of locking mechanisms may be used, as would be understood by one skilled in the art.

Figure 9:
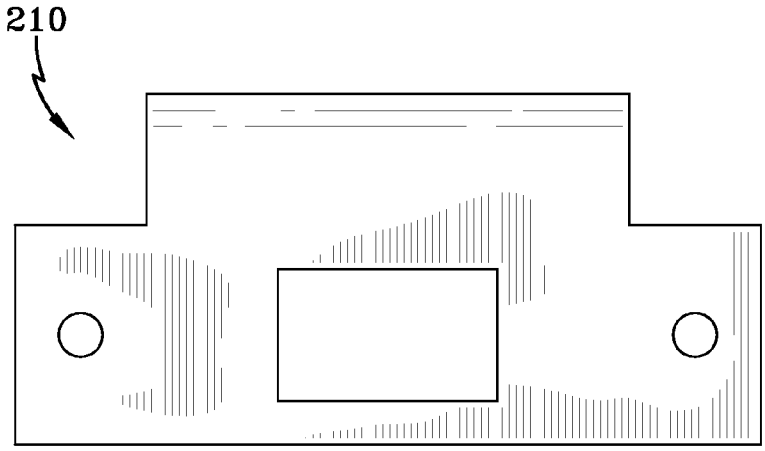
FIG. 9 is a right side view of an exemplary embodiment of a strikeplate.
Figure 10:
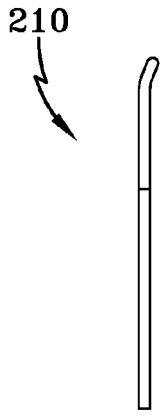
FIG. 10 is a top view of the exemplary embodiment of FIG. 10.

Referring now to FIGS. 6 through 11, another exemplary embodiment of the system 10 is illustrated for the use in ingress doors. In this particular embodiment, the system 10 includes a securing member 200 and a strikeplate 210. As seen in FIG. 9, the strikeplate 210 is rectangular in shape with a projection, with a proximal and distal end, extending from the right edge of the rectangular section. Additionally, the projection is slightly curved and contains an enlarged member at the distal end to facilitate securement of the securing member 200 when the securing member 200 engages the strikeplate 210 in operation. The enlarged member may be any number of geometries and sizes to facilitate the securement of the securing member 200 to the strikeplate 210, although in this embodiment the enlarged member is cylinder in shape. In this embodiment, the projection and enlarged member are integral with the rectangular section of the strikeplate 210 and may be manufactured by any number of manufacturing methods. However, in other embodiments, the projection and enlarged member may be manufactured separately and secured to the rectangular section by any number of fastening means, such as, but not limited to: soldering, welding, etc.

In this particular example, the strikeplate 210 contains a mechanism hole to allow a door's locking mechanism to engage the door frame. The mechanism hole is rectangular in this embodiment, however, depending upon the geometry of the door's locking mechanism, the mechanism hole may be any number of geometries and sizes, as would be understood by one skilled in the art. This example includes two fastening holes to facilitate securing the strikeplate 210 to the door frame. Preferably, but not necessarily, the center of the fastening holes are aligned at complementary locations above and below the mechanism hole on a vertical line that approximately runs through the midpoint of the width of the mechanism hole.

Figure 7:
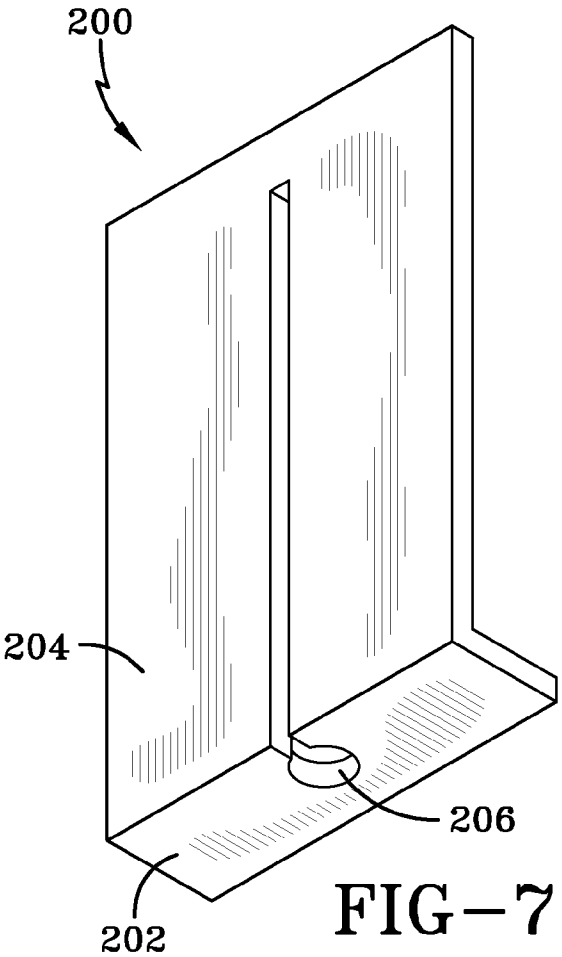
FIG. 7 is a top view of the exemplary embodiment of FIG. 6.
Figure 6:
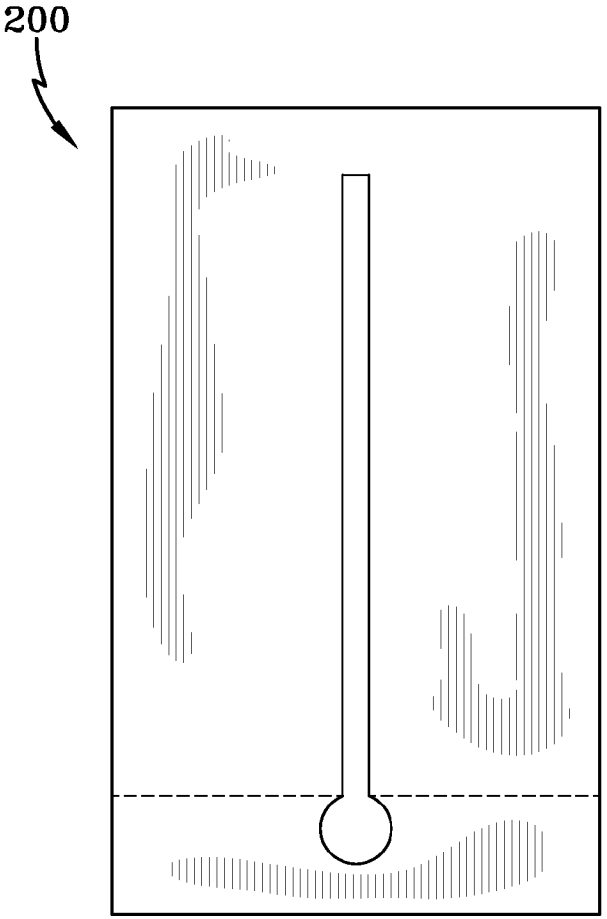
FIG. 6 is a front view of an exemplary embodiment of the body before adding a bend.
Figure 11:
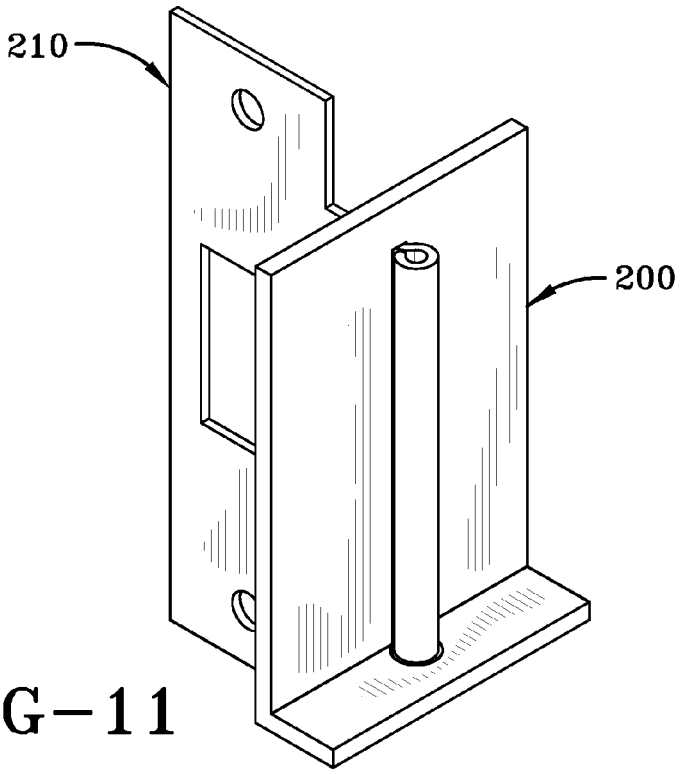
FIG. 11 is a right side view of an exemplary embodiment of the body of FIG. 7 placed in relation to the strikeplate of FIG. 9.

In this example, the securing member 200 includes a horizontal plate 202 and a vertical plate 204. As seen in FIG. 7, the securing member 200 contains a securing aperture 206. In this embodiment, the securing aperture 206 is located on both the horizontal plate 202 and the vertical plate 204, with the securing aperture 206 being substantially circular in shape on the horizontal plate 202 and substantially rectangular on the vertical plate 204. However, the securing aperture 206 may be any number of geometries and sizes to compliment the geometry and size of the projection and enlarged member of the strikeplate 210 during operation of the system 10, as seen in FIG. 11. Furthermore, as seen in FIG. 6, the securing member 200 may be fabricated from a common sheet of material that is bent to fabricate the horizontal plate 202 and the vertical plate 204. However, in other embodiments, each plate may be fabricate individually and secured together by any number of securing means, as would be understood by one skilled in the art.

In this embodiment, the strikeplate 210 and securing member 200 are made of metal. However, in other embodiments the strikeplate 210 and securing member 200 may be made of any number of materials that possess the strength and durability for proper securement of the strikeplate 210 to the securing member 200 during operation.

During operation of the system 10 with an ingress door, in one embodiment, an individual may manually slide the securing member 210 substantially downward so that the securing aperture 206 surrounds at least a portion of the enlarged member at the distal end of the strikeplate 210 and helps facilitate securing the door from opening inward. Typically, when a second individual tries to open the ingress door by pushing the door handle from the outside, at least a portion of the front face of the door will engage a portion of the vertical plate 204 and will cause at least a portion of the securing member 200 engages at least a portion of the strikeplate 210. Further, in most embodiments, at least a portion of the vertical plate 204 will engage at least a portion of the front face of the door frame. The combination of engaging members inhibits the second individual from inwardly opening the door.

Figure 12:
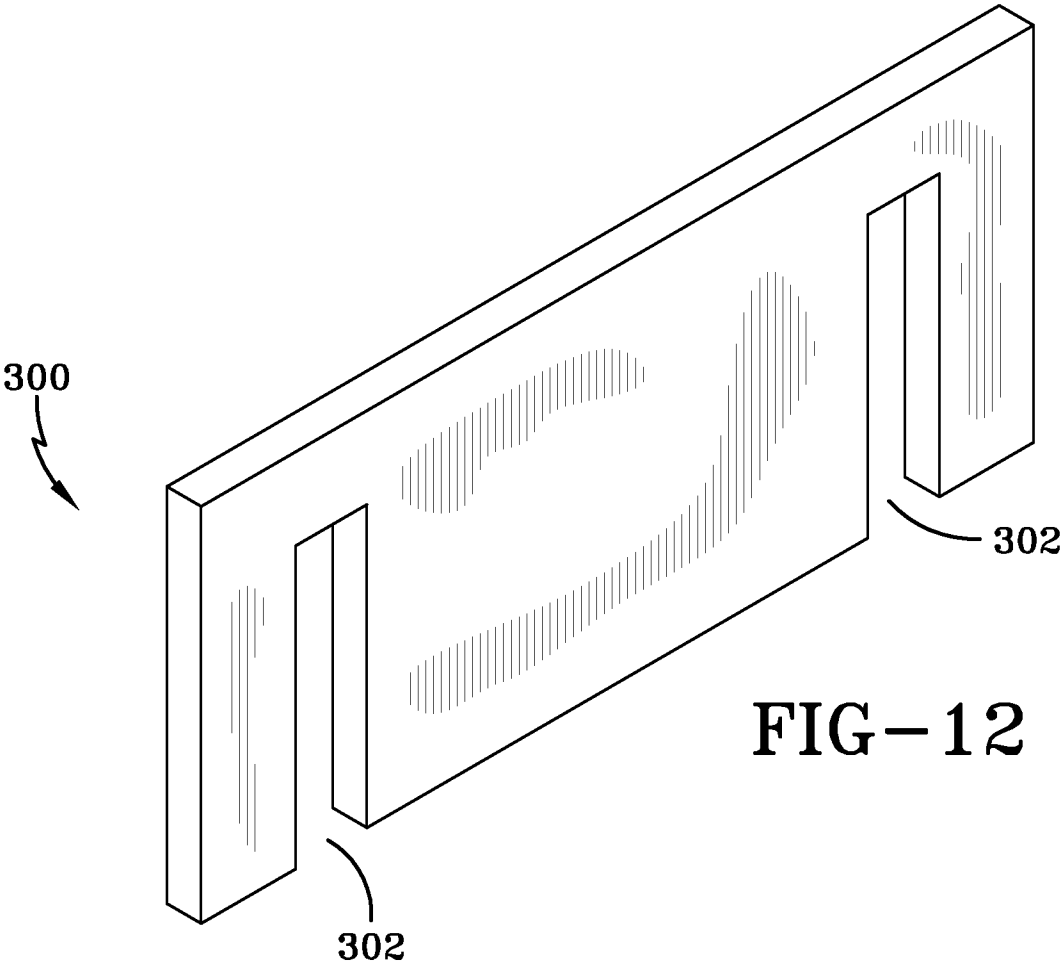
FIG. 12 is a front view of an exemplary embodiment of a body of the door safety system for securing two doors.
Figure 13:
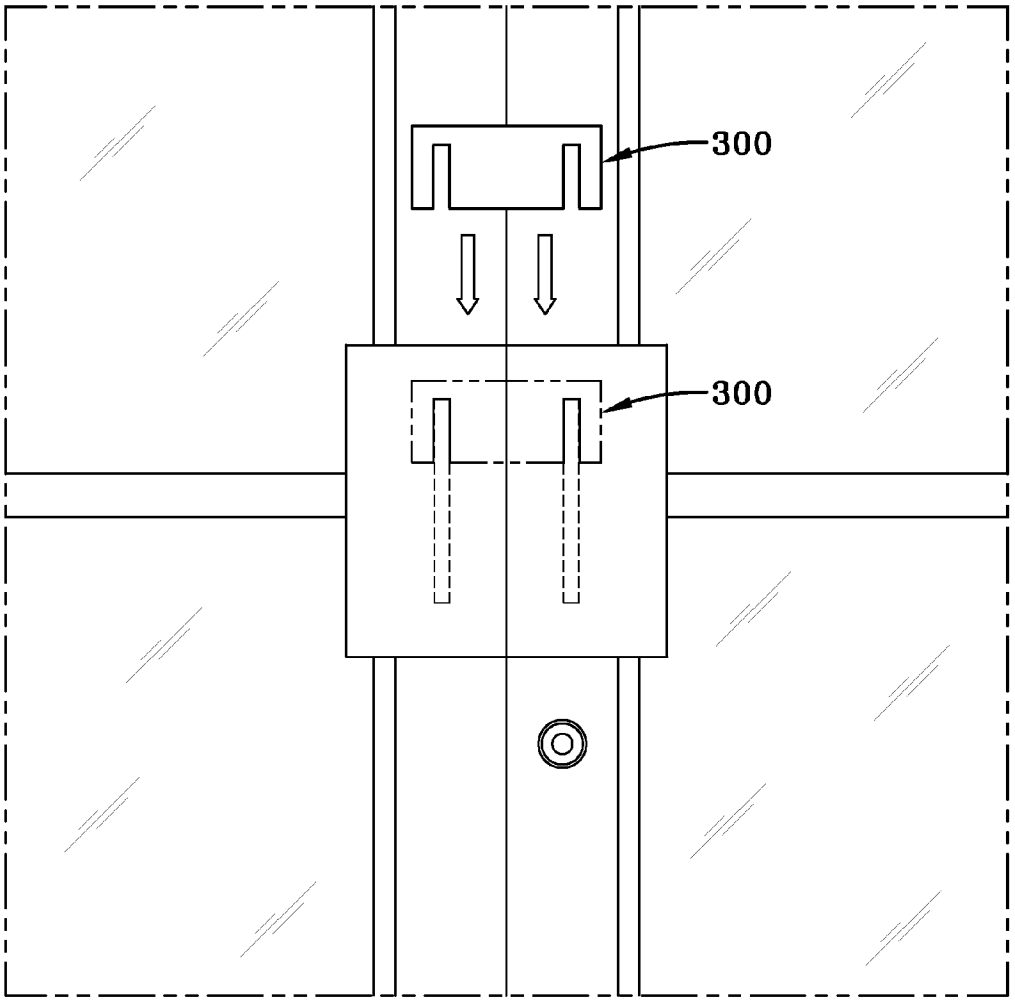
FIG. 13 is a front perspective of an exemplary embodiment of the body of FIG. 12 for securing two doors.

FIGS. 12 and 13 illustrate an exemplary embodiment of the system 10. In this embodiment, a body 300 is used for double-door systems with push-bars. In this example, the body 300 is substantially rectangular in geometry with two securing apertures 302. In other embodiments, the body may be other geometries, as would be understood by one skilled in the art. Additionally, in this example, the securing apertures 302 are rectangular in geometry, initiate at the bottom edge of the body 300 and extend upward within the body 300. In other embodiments, the securing apertures 302 may have any number of geometries and shapes, depending upon the design factors and other operational factors, as would be understood by one skilled in the art that allow the body 300 to secure around control lines of the door mechanisms of double-door assemblies and prevent the double-doors from opening or closing. The securing apertures 302 are located on substantially complementary sides of the horizontal midpoint of the body 300.

In this embodiment, the body 300 is made of metal. However, in other embodiments the body 300 be made of any number of materials that possess the strength and durability for proper securement of the body 300 to the lines of the double-door assembly. Furthermore, in this embodiment, the body 300 is fabricated from one sheet of material, wherein other embodiments, the body 300 may constitute multiple sheets of material that are attached together.

During operation of the system 10 with a double-door system with push-bars, in one embodiment, an individual may manually slide the body 300 substantially downward so that the securing apertures 302 surrounds at least a portion of the control lines for the door mechanism of each door and at least a portion of the body 300 engages at least a portion of the door handles, and helps facilitate securing the door from opening. Typically, when a second individual tries to open the double-door system by pulling the door handle from the outside, at least a portion of the front face of the door handles and will cause at least a portion of body 300 to engage at least a portion of the control lines for the door mechanism. The combination of engaging members inhibits the second individual from outwardly opening the doors.

Figure 14:
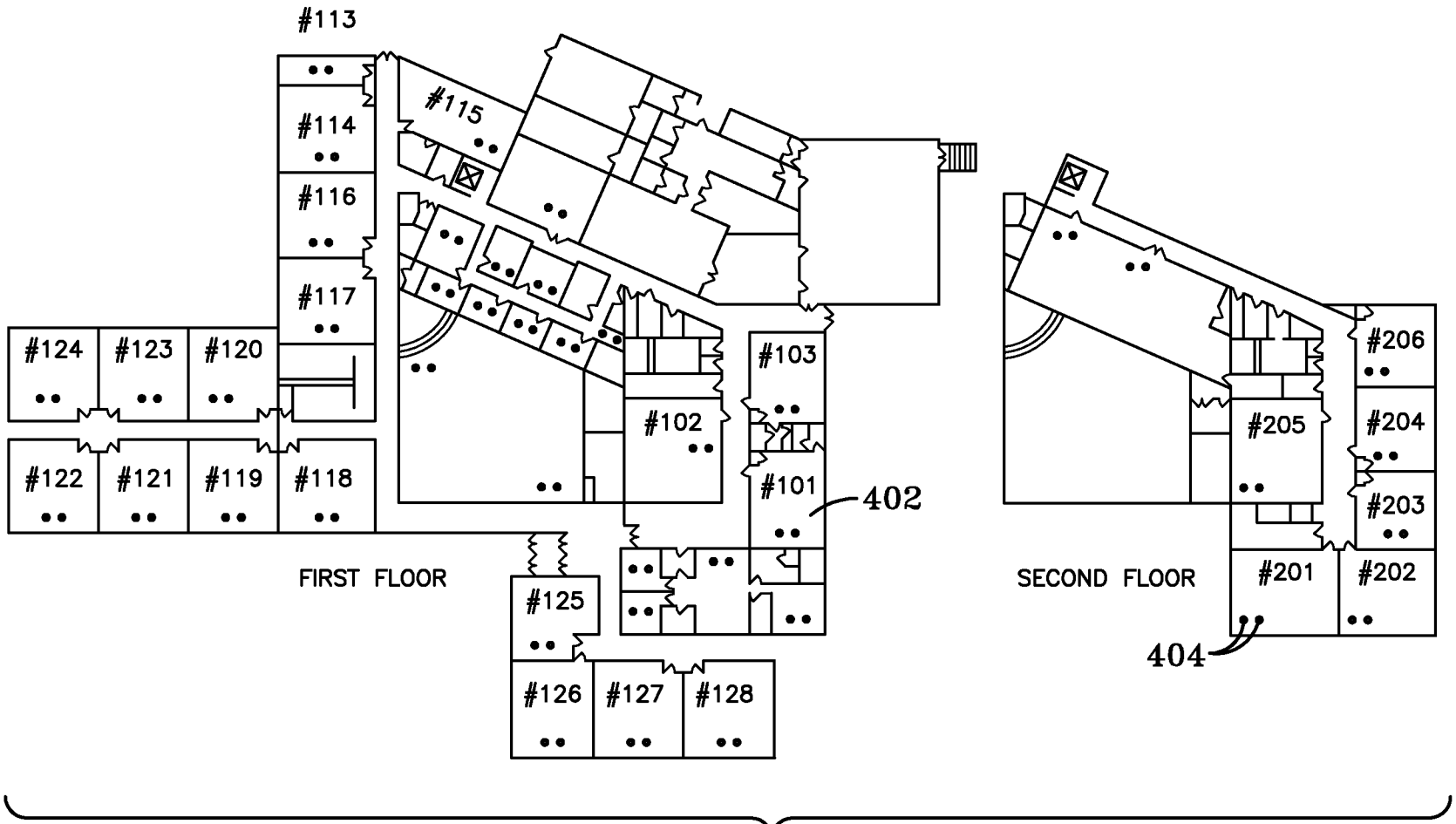
FIG. 14 is a schematic of an exemplary embodiment of the light board.

FIG. 14 illustrates an exemplary embodiment of the system 10 which includes a light board 400. In this particular embodiment, but not necessarily, the light board 400 is linked with the alarm system 134. Additionally, this embodiment of the light board 400 includes a room-diagram 402 of a building, warning lights 404 and a proximity contact that may be linked with the alarm system 134. Preferably, the light board 400 includes a room-diagram 402 of the building or buildings linked with the light board 400. While in this embodiment the room-diagram 402 is an actual floor-plan of the building, in other embodiments, the room-diagram 402 may be a graph, chart, grid table, etc. of the individual rooms located in the building or buildings.

The light board 400 may include multiple warning lights 404 located on the face of the light board 400. Preferably, but not necessarily, the warning lights 404 are diodes of multiple colors, wherein each color illustrates different information. For example, the light board 400 may be set up so that each room of the room-diagram 402 contains a red and green warning light 404. In this example, only one green warning light 404 may light up where the first housing 130 of the system 10 is opened. Furthermore, the red warning lights 404 may represent all the subsequent housings 130 opened in the corresponding rooms. In another example, each warning light 404 may emit multiple colors and only one warning light 404 is needed for each room on the room-diagram 402. One skilled in the art would understand that other examples may contain any number of different colors and number of different devices that emit light as the warning lights 404, depending upon the design factors and other considerations.

When the front body 138 of the housing 130 is not in close approximation to the mounting body 140, the proximity contact between these bodies activate the light board 400 operates by illuminating the corresponding warning lights 404 on the face of the light board 400. In this embodiment, the proximity contact is a self-managed remote magnetic alarm contact, such as the type marketed under the trademark Ademco. Although each proximity contact is self-managed in this embodiment, other embodiments may contain proximity contacts that are linked to a central location and managed by a single central management system. Moreover, the proximity contact 406 need not be magnetic like this embodiment, as one skilled in the art would understand that any number of proximity contacts may be used, wherein in the contact operates when the two components are physically separated. Although other embodiments may have independently operating components, in this embodiment, the proximity contact is connected and activates light and/or sound emitting components of the alarm system 134 when the proximity contact activates.

When the proximity contact activates, exemplary embodiments of the system 10 may perform any number of warning functions. In one embodiment, an auditory alarm may be connected to the proximity contact to notify appropriate personal inside or outside the building. In another embodiment, the police or other proper authorities may be notified of the building and/or the room where the proximity contact activates. In yet another embodiment, the activation of the proximity contact triggers a device that is adapted to send a telephone message to appropriate personal. In one example, the embodiment may send a telephone message to the district personal of a school system. In another embodiment, a central monitoring site may be notified when a proximity contact activates in the system 10. Other embodiments of the system 10 may include any combination of the aforementioned warning functions, in addition to other methods and devices used as warning functions, as one skilled in the art would realize.

What is claimed is:

1. A safety system for a door placed within a frame, the door having a handle, the safety system comprising:

a unitary body having a first portion with an aperture for accepting the door handle and a second portion adapted for engaging the door frame so that the second portion prevents the door from opening; and a securing member having a first portion that is adapted to secure to the door, the securing member having a second portion which extends away from the door to define a gap between the door and the second portion of the securing member;

wherein the first portion of the unitary body contains a flat elongate surface which is sized to fit within the gap so as to engage the unitary body with the securing member and the door frame to prevent the door from opening.

2. The door safety system of claim 1, wherein the second portion of the body has first and second members and the first portion of the body has a third member, wherein the first member runs substantially parallel to the third member, and the second member is approximately perpendicular with and engaged with the first and third members, the third member has the aperture protruding inward from the bottom edge of the third member and is adapted to at least partially surround a doorknob handle.

3. The door safety system of claim 2, wherein the body has a fourth member that is approximately perpendicular and secures to the third member and helps restrict the movement of the body about the door handle.

4. The door safety system of claim 3, wherein the first, second, third and fourth members are integral with one another.

5. The door safety system of claim 2, wherein the top of the aperture is substantially curved and the sides of the aperture run substantially parallel with a vertical side of the third member.

6. The door safety system of claim 1, wherein the first portion of the securing member has a first member and the second portion has a second and third member, the first member of the securing member runs substantially parallel to the third member of the securing member, and the second member of the securing member is approximately perpendicular with the first and third members of the securing member.

7. The door safety system of claim 6, wherein the first portion of the securing member has at least one hole to facilitate securement to a door.

8. The door safety system of claim 7, wherein the first member of the securing member has two holes with one hole aligned substantially vertical above the second hole.

9. The door safety system of claim 1, wherein the first and second portions of the securing member are integral with one another.

10. The door safety system of claim 1, further comprising a housing that comprises:

a fastening mechanism;

an alarm system;

a means for mounting the housing to a wall;

a front body; and a mounting body.

11. The door safety system of claim 10, further comprising a lightboard that comprises:

a room-diagram of a building;

a warning light; and a proximity contact that is linked with the alarm system of the housing.

12. A safety system for a door placed within a frame, the door having a handle, the safety system comprising:

a body with a first, second, third and fourth members, wherein the first member runs substantially parallel to the third member, the second member runs substantially parallel to the fourth member, the second member is approximately perpendicular with and engaged with the first and third members, the fourth member is approximately perpendicular with the third member, the third member has an aperture protruding inward from a bottom edge of the third member that is adapted to at least partially surround the doorknob handle, and a securing member with a first, second and third member wherein the first member of the securing member runs substantially parallel to the third member of the securing member, and the second member of the securing member is approximately perpendicular with the first and third members of the securing member, the first member of the securing member has at least one hole to facilitate securement to the door, wherein the first member of the body is adapted to engage with the door frame to prevent the door from opening.

13. The door safety system of claim 12, wherein the first member of the securing member has two holes with one hole aligned substantially vertical above the second hole.

14. The door safety system of claim 12, wherein the first, second, third and fourth members of the body are integral with one another.

15. The door safety system of claim 12, further comprising a housing that comprises:

a fastening mechanism;

an alarm system;

a means for mounting the housing to a wall;

a front body; and a mounting body.

16. The door safety system of claim 15, further comprising a lightboard that comprises:

a room-diagram of a building;

a warning light; and a proximity contact that is linked with the alarm system of the housing.

17. A safety system for a door placed within a frame, the door having a handle, the safety system comprising:

a body with a first, second, third and fourth members, wherein the first member runs substantially parallel to the third member, the second member runs substantially parallel to the fourth member, the second member is approximately perpendicular with and engaged with the first and third members, the fourth member is approximately perpendicular with the third member, the third member has an aperture protruding inward from a bottom edge of the third member that is adapted to at least partially surround the doorknob handle, and a securing member with a first, second and third member wherein the first member of the securing member runs substantially parallel to the third member of the securing member, and the second member of the securing member is approximately perpendicular with the first and third members of the securing member;

wherein the first member of the body is adapted to engage with the door frame to prevent the door from opening;

a housing that comprises:

a fastening mechanism;

an alarm system;

a means for mounting the housing to a wall;

a front body; and a mounting body; and a lightboard that comprises:

a room-diagram of a building;

a warning light; and a proximity contact that is linked with the alarm system of the housing.

* * * * *